United States Patent [19]

Lemaire

[11] 4,044,959

[45] Aug. 30, 1977

[54] PROCESS AND APPARATUS TO WIND CONTINUOUSLY THREAD ON A SUCCESSION OF REELS

[75] Inventor: Roland Lemaire, Fere-en-Tardenois, France

[73] Assignee: Etudes et Fabrications, France

[21] Appl. No.: 690,394

[22] Filed: May 27, 1976

[30] Foreign Application Priority Data

May 29, 1975 France ..... 75.16848

[51] Int. Cl.[2] ..... B65H 54/00

[52] U.S. Cl. ..... 242/25 A

[58] Field of Search ..... 242/25 A, 25 R, 18 A

[56] References Cited

U.S. PATENT DOCUMENTS

| | | | |
|---|---|---|---|
| 2,674,414 | 4/1954 | Hicks | 242/25 A |
| 2,971,708 | 2/1961 | Detrick | 242/25 A |
| 3,026,053 | 3/1962 | Sisson | 242/25 A |
| 3,441,229 | 4/1969 | Henrich | 242/25 A |
| 3,596,844 | 8/1971 | Engmann | 242/25 A |
| 3,695,528 | 10/1972 | Toki | 242/25 A |

*Primary Examiner*—Edward J. McCarthy
*Attorney, Agent, or Firm*—Kane, Dalsimer, Kane, Sullivan and Kurucz

[57] ABSTRACT

An apparatus and a method to wind a thread on a succession of reels, comprising two crown wheels or annuli having parallel and nearly horizontal axes, each of them supporting a coaxial reel, a traversing mechanism having a movable pulley displaced above the reels and able to feed the thread in regular layers, means being provided to cut the thread after the winding of a first reel and means to then ensure continuously the winding of the thread around a second empty reel.

The apparatus comprise a first movable catch pin being positioned near the empty reel to ensure the gripping of the thread, to allow the cutting of the thread and the coupling of this thread around said empty reel, a second movable catch pin placed near the full reel to grip and maintain the thread perpendicularly to the axis of the full reel after the cutting of thread, and means to control the position of the catch pins at the end of the filling of said first reel.

9 Claims, 4 Drawing Figures

III
13
12
7
11
18
10
5
9
33
32
31
16
15
35
34
28
20
29
2
22
26b
26
27c
39
19
1
6
27b
25
41
26a
38
37
P
27a
21
24
III 29
45
46
47
48
31
5
9
18
13
11
12
10
7
14
15
16
17
8a
8
36
34
34a
G
27b
27
27a
38
37
H
27c
44
42
43
45
48
47

PROCESS AND APPARATUS TO WIND CONTINUOUSLY THREAD ON A SUCCESSION OF REELS

The invention relates to a method and an apparatus to continuously wind a thread coming from the output of a production unit on a first reel, and when this reel has been filled to capacity, on a new empty reel and so on.

The invention relates more particularly to a winding apparatus comprising two annular crowns or annuli with parallel axes, practically horizontal, each of them carrying a reel or bobbin, a mechanism having a pulley movable above said reels and able to feed the thread irregular layers around those reels, means to cut the thread when the first reel has been filled to capacity, and means to insure that the thread will then be wind around the other reel without discontinuity.

In the already known apparatus of this type the switching-over of the thread from the first filled reel to the second empty reel is carried by a servo-mechanism which brings the pulley of the traversing mechanism above the second reel when the length of thread wound around the first reel has reached a predetermined value.

The thread is set tangentially to a flange of the empty reel and at the same time continues to be wound around the reel being filled. A catch pin situated between the two reels is then activated and draws the thread in a backward direction; the thread is then coupled against the flange of the empty reel by a clamp member, and then cut on a anvil. The remaining slack portion of the thread is wound around the full reel and at the same time the winding of the thread around the second empty reel begins.

This apparatus has drawbacks:

the catch pin which grips the thread is placed in between the two reels and at the same distance of those reels, and in a backward position with respect to those reels, in such a way that the displacement time and the displacement itself are relatively important, and as a result, the risk of the thread being catched by the projected portion of the clamp member and hence of experiencing a breakage is increased;

the catch pin is not close to the clamp member, and as a result the thread can be subjected to vibrations, and hence, its engagement by the clamp member might be imperfect;

the angle at which the thread is engaged in a protective cover positioned in front of the reel being filled being particularly important, the angles of the thread with respect to the planes of the turns where the winding around the reel take place are relatively high, and the thread is strongly acted upon on both sides of the catch pin, which is not desirable;

the remaining length of thread which must be wound around the full reel after the cutting of thread can escape from the protective cover, due to its high entrance angle in this protective cover. The thread then sweeps violently and damages the turns already wound between the flanges of the full reel, the thread being in some cases insulated.

It is an object of this invention to provide a winding apparatus free from those drawbacks, and in which, especially, the risk of damaging of the thread at the end of the filling of a reel is practically suppressed.

According to the invention, an apparatus of the type referred to above comprises a first movable catch pin to grip the thread, placed near the empty reel to allow the cutting of the thread and its coupling around said empty reel, a second movable catch pin being placed near the already full reel to catch and maintain the thread in a direction perpendicular to the axis of said full reel after the cutting of the thread, and means to control said catch pins at the end of the filling of a reel.

Maintaining the remaining slack portion of the thread perpendicularly to the axis of the full reel, that is to say in a direction parallel to its winding plane, allows the protective cover to keep control of the thread, and hence avoids any damage made to the already wound turns. On a particularly well-adapted realisation of the invention, the catch pins are carried by a table rotatively mounted about an horizontal axis, each catch pin comprising a linear part and a curved part forming between them a reception interval for the thread, each catch pin being itself rotatively mounted about an horizontal axis, and being acted upon by a longitudinally displaceable stem linked to the control means.

The rotation of the catch pins and the rotation of the table enable a correct positioning of those elements, the thread being engaged between the linear parts and the curved parts of the catch pins.

The process of the invention to wind a thread continuously on a succession of reels is characterised by the fact that the thread tangent to a flange of the reel is catched near this reel; the thread is then pulled backwards to allow its coupling on said empty reel and its cutting, the remaining slack portion of the thread which is to be wound on the filled reel being maintained near said filled reel on a trajectory roughly perpendicular to the axis of said filled reel.

Other aspects and advantages of the invention will be made clear in the following detailed description made with reference to the accompanying drawings where:

Figure 1:
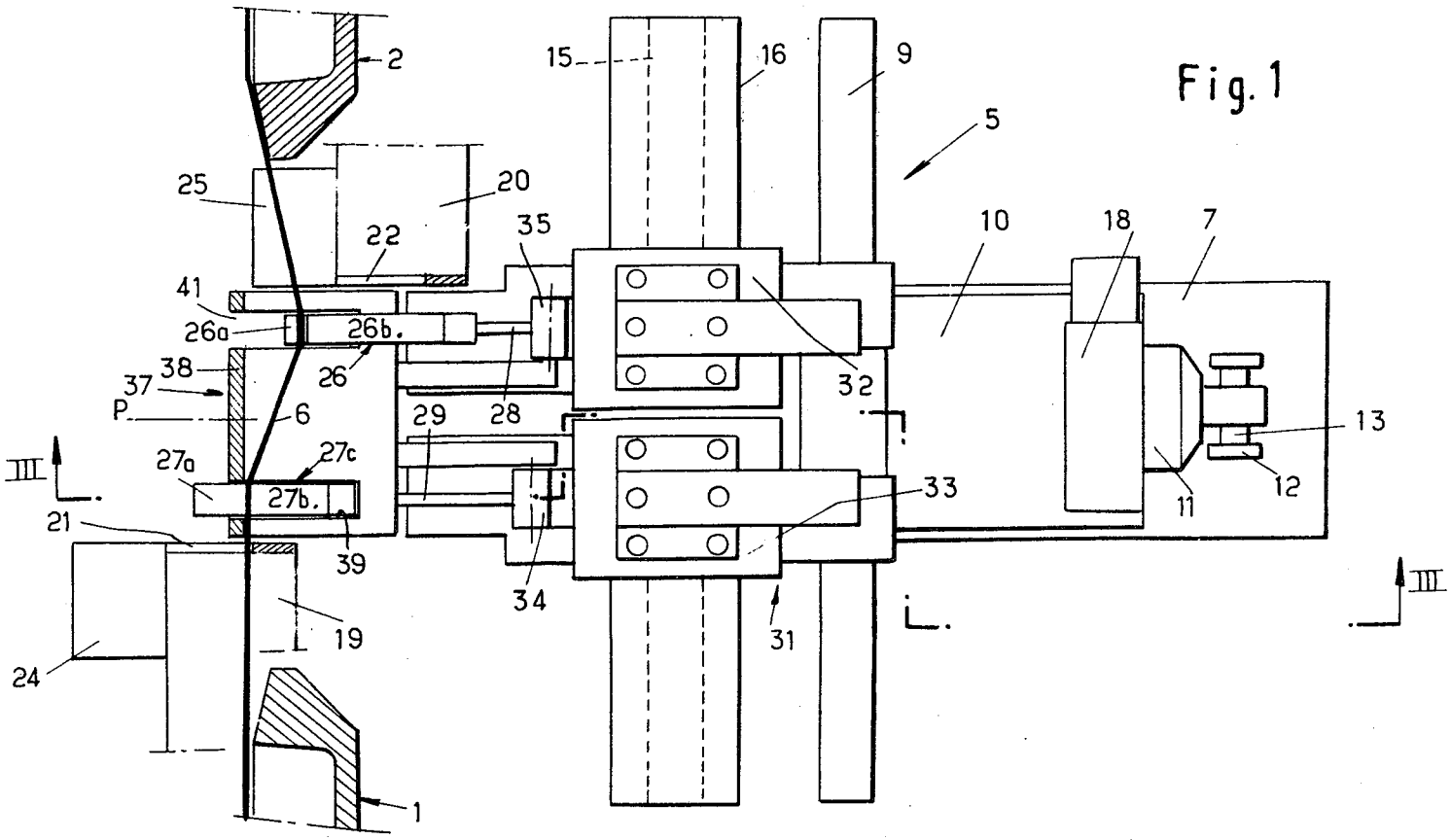
FIG. 1 is a diagrammatic view with partial cuttings of an example of realisation of said winding apparatus.
Figure 2:
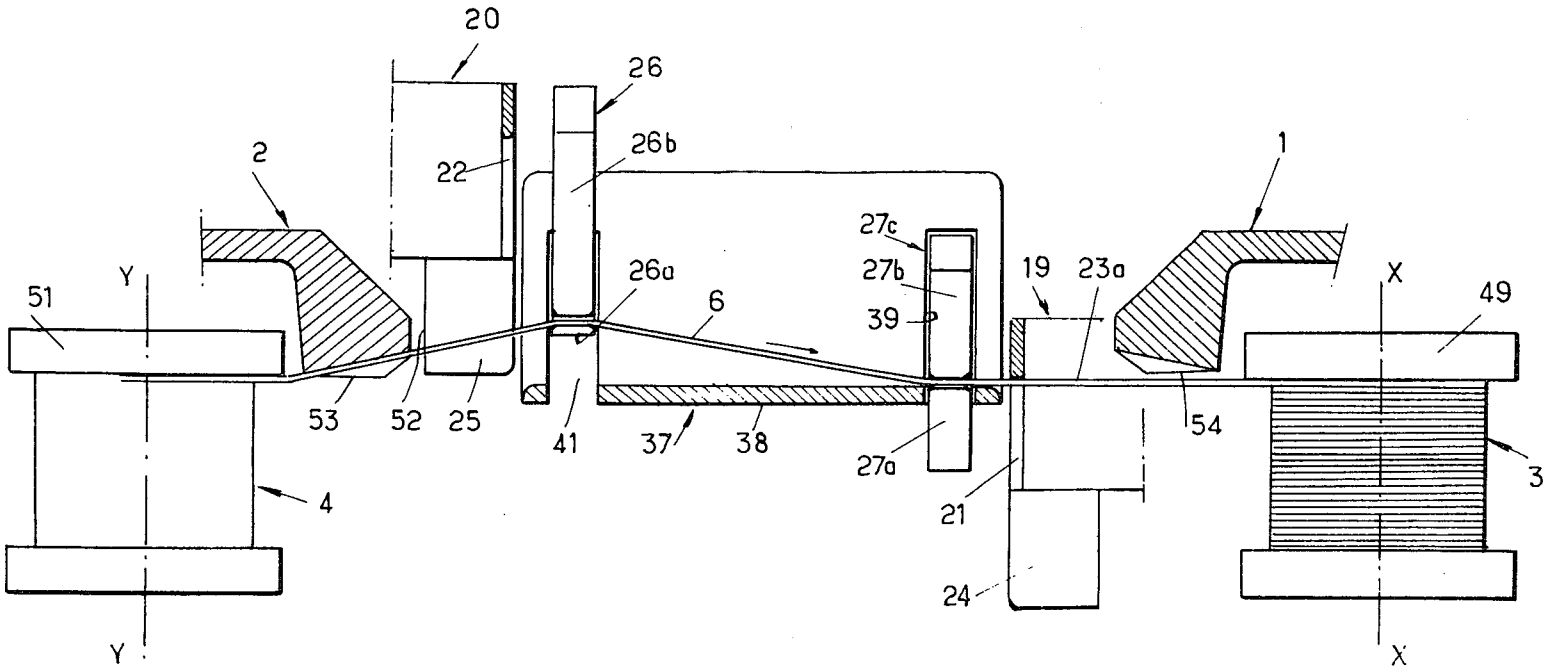
FIG. 2 is a partial diagrammatic view at an enlarged scale of the apparatus of FIG. 1.
Figures 3, 4:
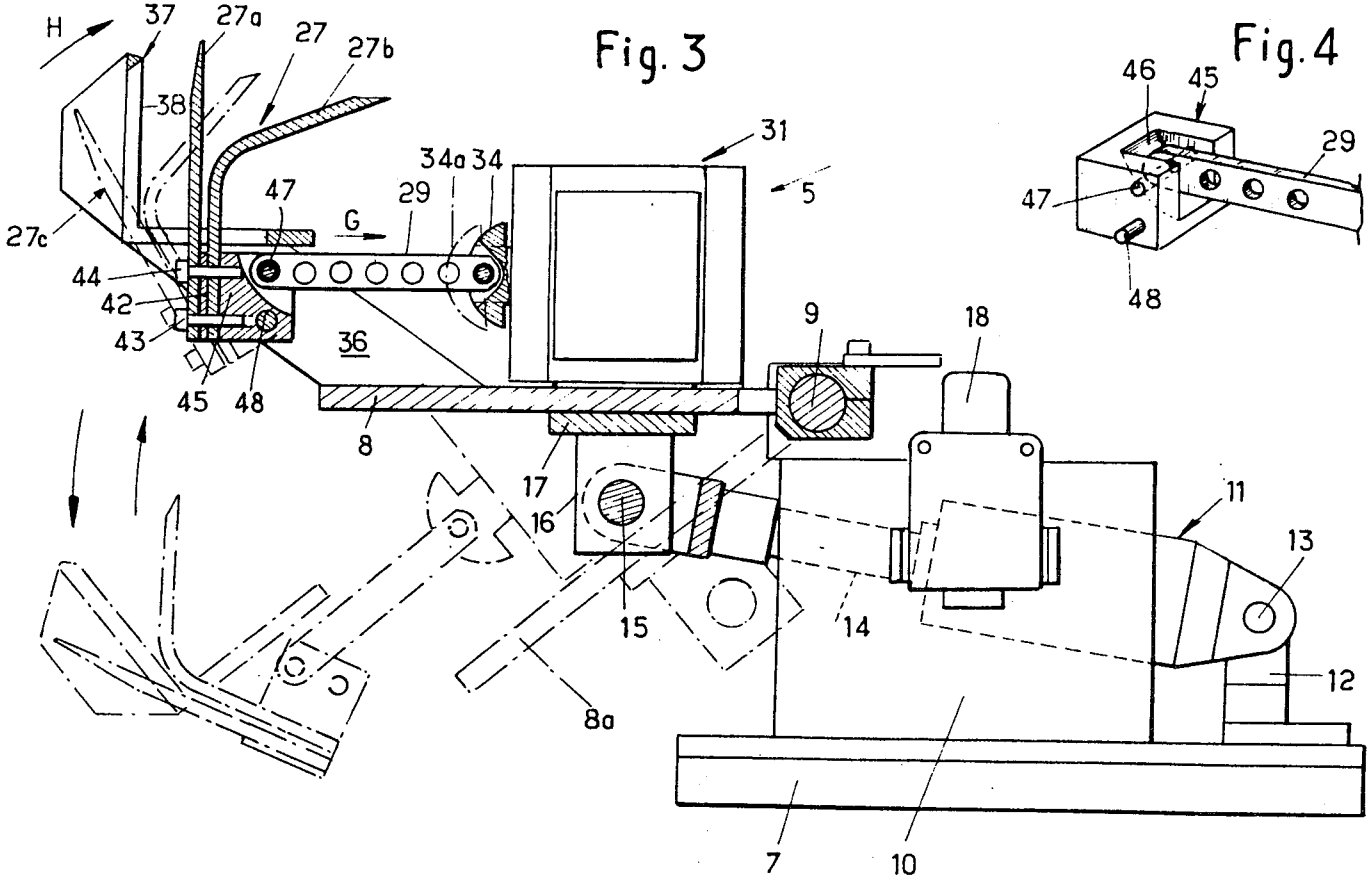
FIG. 3 is a sectional view following line III—III of FIG. 1.
FIG. 4 is a perspective view with cuttings at an enlarged scale of a detail of the apparatus of FIGS. 1 to 3.

The apparatus used to wind the thread on reels or bobbins shown on FIGS. 1 to 3 comprises two crowns wheels 1, 2 or annuli whose rotation axes, X—X and Y—Y respectively, are parallel and practically horizontal. The crowns wheels 1, 2 or annuli are set into rotation by shafts (not shown), and each of them carries a co-axial reel or bobbin 3, 4.

Between the annuli 1 and 2, is placed a control system 5 which will switch over the thread 6 from an already filled up with a pre-determined length of thread reel (reel 3 in the particular apparatus shown on FIG. 2), to the second empty reel which is to be filled (reel 4, FIG. 2). The control system 5 comprises a frame 10 mounted on a base plate 7 and supporting an oscillating table 8 which can rotate with respect to a horizontal axle 9 fixed on the frame 10.

The thread 6 can for example be made of copper, and can come from a wire-drawing apparatus, and can eventually be an insulated thread.

A jack 11 is supported by a stand 12 fixed on the base plate 7, on the side of the base plate opposite to the annuli 1 and 2. The jack 11 can rotate about the stand 12 around an horizontal pin 13. The jack 11 crosses the frame 10 and the end of its rod 14 can rotate about an horizontal axle 15 which crosses the case 16 supported by a plate 17 itself fixed on the underside of the oscillating table 8.

The jack 11 is linked by ducts (not shown) to a control unit 18 situated on the frame 10, and can rotate the oscillating table 8 around the horizontal axle 9, to bring it in due course from the horizontal position shown in thick line on FIG. 3 to a position tilted toward the base plate 7 shown in dotted lines by 8*a*.

Two protective covers 19, 20 are associated to the annuli 1 and 2, respectively. The protective covers 19, 20 are disposed between and close to the annuli 1 and 2, and they can be moved in a direction parallel to the axes of those annuli in a known way, in order to cooperate with those annuli. For this purpose, two transversal slots respectively 21 and 22, are made in the protective covers 19 and 20, in order to allow the passage of the thread 6 inside the protective cover 19 or 20 at the end of the winding of the corresponding reel. Each protective cover 19 and 20 is fixed on an anvil 24, 25, respectively, which can cut the thread 6 once the reel has been filled up and once the winding of the thread on the other reel has begun.

A reel traversing mechanism known in itself and not shown, comprising a pulley movable above the reels, insures that the thread is regularly distributed on the reels by transferring the thread alternatively from on flange of the reel to the other by a continuous automatic process.

According to the invention, the winding apparatus comprises a first movable catch pin 26, which insures the gripping of the thread 6 situated near an empty reel (reel 4 in the example shown, FIG. 2), to allow the cutting of the thread 6 and its coupling around the empty reel 4.

The invention also provides a second movable catch pin 27, placed near the reel which is being filled (reel 3 in the example shown), to catch and maintain the thread 6 perpendicularly to the axis X—X of the reel 3 after its cutting. Means are also provided for a synchronised control of the catch pins 26 and 27 at the end of the filling of one or of the other of the reels 3 and 4. The catch pins 26 and 27 can rotate between the protective covers 19, 20, near the end of two horizontal stems 28, 29, those stems being lengthwise movable by a control block 31 fixed on the oscillating table 8. The control block 31 includes electromagnets 32, 33, linked to an electric source not shown, and able to initiate the motion of the stems 28, 29 through the action of the push buttons 34, 35 on which the stems 29, 28 are respectively mounted about horizontal axis.

On the oscillating table 8 and near the protective covers 19, 20, are fixed two vertical metallic plates (only the plate shown as plate 36 associated with the catch pin 27 is shown on FIG. 3) supporting a metallic transversal L-shaped iron 37 which occupies the space left between the protective covers 19 and 20 although a small clearance is provided for between the L-shaped iron 37 and the two protective covers 19 and 20. The front wall 38 of the L-shaped iron 37 is provided near its ends with two slots 39, 41 allowing the passage of catch pins 27, 26 when those catch pins rotate in vertical planes.

Each of those catch pins 26, 27 comprises a projection or straight part 26*a*, 27*a*, respectively, and a projection or curved part 26*b*, 27*b*, respectively, which provide between them an interval wide enough to receive the thread 6. The upper part of the curved projection 27*b* forms with the contiguous upper part of the straight projection 27*a*, a roughly triangular volume one of the angles of this triangular volume opening into the interval used to receive the thread 6. The catch pin 26 has of course the same configuration, as the catch pins 26 and 27 are symmetrical with respect to a vertical plane P which is also a symmetrical plane for the control system 5. The lower portions of the projections of the catch pin 27 are maintained separated by an intercalated part 42 whose width fixes the extent of the interval existing between the straight projection 27*a* and the curved projection 27*b*. These projections are joined by a pair of vertically spaced bolts 43, 44 screwed into a block 45 through the projections 27*a* and 27*b*. The block 45 can rotate about a pin 48. The end of the stem 29 engages rotatably a notch 46 made into the center part of the block 45. A transversal pin 47 runs through the stem 29 and is supported by the block 45. The second pin 48 is fixed on the block 45 in a direction perpendicular to the direction of the notch 46, and is positioned under the pin 47, one end of the pin 48 is integral with the associated supporting plate 36.

Hence, when the stem 29 is pushed forward (in a position illustrated in dotted line by 34*a*), the stem 29 pushes forward the pin 47 and the block 45 rotates about the transversal pin 48. At the same time, the catch pin 27 is tilted in a vertical plane from its position illustrated in solid line (FIG. 3), to the position showed in dotted lines in 27*c*. Between those two positions, the catch pin 27 has made a rotation of about 30° around the horizontal pin 48.

The catch pin 26 rotates about the associated stem 28, in a similar fashion.

The winding apparatus runs in the following way:

When the thread 6 is being wound around the reel 3, the rod 14 of the jack 11 is pulled back, the table 8, the stems 28, 29 and the catch-pins 26 and 27 are then in their pulled back position, shown in dotted lines in FIG. 3.

A pre-selected counter counts a pre-selected length of thread wound around the reel 3, corresponding to the complete filling of this reel. The counter initiates the displacement of the reel traversing pulley which brings the thread 6 tangentially to the flanges 49, 51 of the reels 3 and 4. At the same moment, a cut-off contact actuates the control unit 18, which in turn actuates the jack 11. The rod is pushed out of the housing of the jack 11, rotates the oscillating table 8 with its control block 31, the catch-pins 26, 27 and the L-shaped iron 37, to position them in the horizontal position shown on FIG. 3, the catch-pins 26 and 27 being then in their positions 26*c* and 27*c*, the position 27*c* being the only one visible on FIG. 3. Prior to this, the pulley of the traversing mechanism (not shown) has been displaced toward reel 4 which is to be filled up. When the oscillating table 8 moves upwards in its horizontal position, the thread 6 is catched between the straight projections 26*a*, 27*a*, and the curved projections 26*b*, 27*b* of the catch-pins 26 and 27.

The protective cover 19 is moved forwards and the thread 6 passes through the horizontal slot 21 of this protective cover 19. On the other hand, the protective cover 20 is in a backward situation with respect to the annulus 2 (FIGS. 1 and 2) the cutting edge 52 of the anvil 25 being hence in a backward position with respect to the vertical plane comprising the front wall 38 of the L-shaped iron 37. The control block 31 activates the electro-magnet 32 which pulls the supporting stem 28 (arrow G, FIG. 3). The catch pin 26, which was in the position illustrated in dotted lines by 27*c* (FIG. 3) rotates then about the pin 48 in the direction of the arrow H. During this rotation, the catch-pin 26 carries the thread 6 backwards and takes the position shown on FIGS. 1 and 2.

At this stage the thread 6 passes through the catch-pin 26. The thread then nears the front wall 38 due to the position of the catch-pin 27, the angle between the thread 6 and the front wall 38 laying around 10 degrees in the example shown.

The back-positioning of the thread 6 by the catch pin 26 allows a peripheral clamp member 53 of the annulus 2 to grip the thread 6. This in turn initiates the cutting of the thread 6 on the cutting edge 52 of the anvil 25 and at the same time initiates the beginning of the winding of the thread 6 around the drum of the reel 4 in a way known in itself. The remaining slack portion of the thread 6 passes through the catch pin 26 and the catch pin 27 successively and is then wound around the reel 3, the catch-pin 27 restricting the thread 6 along a trajectory fairly perpendicular to the axis X—X. of the filled up reel 3.

This reel is then stopped in a way known per se, and at the same time the pulley of the traversing mechanism sets the thread around the reel 4. The control unit 18 initiates the pull back of the rod 14 of the jack 11, which in turn rotates the oscillating table 8 and the catch-pin 26, 27 around the rotation axle 9. The previously cited parts are then in their pulled back position shown in dotted lines on FIG. 3. The reel 3 is taken away and replaced by a new empty reel. When the winding of the reel 4 is ended, the preselected compter detects the length of the thread corresponding to the filling of the reel 4, and the thread switching-over process from reel 4 to the new empty reel replacing reel 3 takes place as already described, the parts played by the catch-pins 26, 27 and by the protective covers 19 and 20 being inverted.

The apparatus and the process of the invention can be used, for example, for the processing of metallic threads in a wire-drawing installation, or else for an electric conductor comprising a metallic central core and an insulating sheath in a cable cord installation.

The travel of the catch pins 26, 27, which is smaller than that of the catch pin provided by the known previous apparatus, reduces the interval of time during which thread 6 is moved, and hence reduces the probability of the thread 6 being catched by the projected part of the clamp member 53 and the vibrations of the thread 6 are also strongly damped by the displacement of the catch pin 26 near the clamp member 53, or by the displacement of the catch pin 27 near the associated clamp member 54 of the annulus 1, when the switching-over of the thread is made from reel 4 to the empty reel replacing reel 3.

As the transversal travel of the thread 6 is reduced, the angles made by this thread on both sides of the catch pin 26 (or 27) are practically identical, and very much inferior to the angles made by the thread in the known previous realisation having only one catch pin. The thread is hence less acted upon, which enhance the switching-over process.

The forward position of the catch pin 27*c* (FIGS. 2 and 3) compels the thread 6 to a linear trajectory which is practically tangential to the flange 49 of reel 3, prior to its entrance in the protective cover 19. The disastrous oscillations taking place in the already known apparatus during which the residual slack portion of the thread to be wound on reel 3 has a trajectory and an angle resulting of the positioning of the central catch pin and of the entrance edge of the protective cover 19, the thread hence escaping from this protective cover are avoided. The thread which is inserted in the protective cover 19 cannot anymore sweep over and deterioriate the already wound turns on reel 3.

The invention is not limited to the example of realisation described and allows for variations of its execution. For example, the catch pins 26 and 27 can be made in a single molded part, the intercalated part 42 used between the straight projections and curved projections being then supressed. Indeed, instead of thread, one can also use any such element of the class including yarns, rovings, tapes, wires, cables, ropes, cords and the like. Similarly, the word "reel" has been used in a broad sense to include any winding or reel member.

What is claimed is:

1. An apparatus to wind a thread on a succession of reels, comprising two annuli with parallel and practically horizontal axes, each carrying a coaxial reel, a reel traversing mechanism provided with a pulley movable over the reels for feeding of the thread around the reels in regular layers, means for cutting the thread when one reel has been filied up, means to then ensure without stopping the winding of the thread around a second empty reel, comprising a first movable catch pin being positioned near the empty reel to ensure the gripping of the thread, to allow the cutting of the thread and the coupling of this thread around said empty reel, a second movable catch pin placed near the full reel to grip and maintain the thread perpendicularly to the axis of said full reel after the cutting of thread, and means to control the position of said catch pins at the end of the filling of said first reel.

2. An apparatus as defined in claim 1, comprising a table supporting said catch pins, said table movable about an horizontal axis, said catch pins being rotatively mounted about horizontal pins placed near the end of longitudinally movable stems controlled by the controlling means.

3. An apparatus as defined in claim 1, each catch pin comprising a straight part and a curved part forming between them an interval where the thread can be set.

4. An apparatus as defined in claim 3, the straight parts and the curved parts of each catch pin being separated by an intercalated part and being fixed by bolts screwed into a block, said block being rotatively mounted near the end of the longitudinally movable stem.

5. An apparatus as defined in claim 4, said block being rotatively mounted about a transversal pin, said pin being fixed on a plate itself fixed on the table.

6. An apparatus as defined in claim 2, said stem being controlled by controlling electromagnets.

7. An apparatus as defined in claim 2, the table comprising an L-shaped iron whose front wall is slotted about its ends situated near the reels, those slots allowing the catch pins to rotate.

8. A method to wind continuously a thread on a succession of reels, the thread near the empty reel being tangential to the flange of that reel, said thread being gripped near said empty reel and pushed backwardly to allow its coupling to said empty reel and to allow its cutting, the remaining slack portion of the thread being wound on the filled up reel after being maintained along a trajectory nearly perpendicular to the axis of said filled up reel.

9. An apparatus as defined in claim 2, each catch pin comprising a straight part and a curved part forming between them an interval where the thread can be set.

* * * * *